US006769267B2

(12) United States Patent
Ebara et al.

(10) Patent No.: US 6,769,267 B2
(45) Date of Patent: Aug. 3, 2004

(54) MULTISTAGE COMPRESSOR

(75) Inventors: Toshiyuki Ebara, Gunma (JP); Satoshi Imai, Gunma (JP); Masaya Tadano, Gunma (JP); Atsushi Oda, Gunma (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 10 days.

(21) Appl. No.: 10/221,163

(22) PCT Filed: Mar. 30, 2001

(86) PCT No.: PCT/JP01/02828

§ 371 (c)(1),
(2), (4) Date: Sep. 18, 2002

(87) PCT Pub. No.: WO01/73293

PCT Pub. Date: Oct. 4, 2001

(65) Prior Publication Data

US 2003/0126885 A1 Jul. 10, 2003

(30) Foreign Application Priority Data

Mar. 30, 2000 (JP) ..... 2000-93719

(51) Int. Cl.[7] ..... F25D 19/00

(52) U.S. Cl. ..... 62/296; 62/505; 62/510; 417/366; 181/403

(58) Field of Search ..... 62/505, 508, 510, 62/296; 417/366, 410.3; 418/5, 13; 181/403

(56) References Cited

U.S. PATENT DOCUMENTS 4,958,993 A * 9/1990 Fujio ..... 418/55.3
5,037,278 A * 8/1991 Fujio et al. ..... 418/55.2
5,094,085 A 3/1992 Irino
5,242,280 A 9/1993 Fujio
5,322,424 A 6/1994 Fujio
5,520,526 A * 5/1996 Fujio ..... 418/55.4
5,857,348 A * 1/1999 Conry ..... 62/209
5,980,218 A * 11/1999 Takahashi et al. ..... 417/243
6,009,722 A * 1/2000 Choi et al. ..... 62/505
6,155,802 A * 12/2000 Choi et al. ..... 417/366
6,179,589 B1 * 1/2001 Bass et al. ..... 418/55.1
6,273,691 B1 * 8/2001 Morimoto et al. ..... 418/15
6,568,198 B1 * 5/2003 Tadano et al. ..... 62/217

FOREIGN PATENT DOCUMENTS

JP 403039864 A * 2/1991
JP 5-256285 10/1993
JP 6-33886 2/1994
JP 2723610 11/1997

* cited by examiner

*Primary Examiner*—William E. Tapolcai
*Assistant Examiner*—Mohammad M. Ali
(74) *Attorney, Agent, or Firm*—Westerman, Hattori, Daniels & Adrian, LLP

(57) ABSTRACT

Refrigerant compressed by a first stage compression elements (30) run by a motor (20) is discharged in the closed container (10) via a silencer chamber (35) to cool the motor (20) before the refrigerant is led to a second stage compression element (40). The refrigerant is discharged from the second stage compression element (40) out of the compressor after it is further compressed in the second compression element (40). Thus, the motor (20) is cooled in a simple cooling mechanism during normal operation of the compressor.

4 Claims, 5 Drawing Sheets

MULTISTAGE COMPRESSOR

FIELD OF INVENTION

The invention relates to a multistage compressor, and more particularly to a refrigeration system for use in such multistage compressor.

BACKGROUND OF THE INVENTION

Compressors, particularly rotary compressors, have been used in different fields of engineering, especially in air conditioners and refrigeration systems. These compressors mostly use chlorides containing refrigerants such as R-22 (hereinafter referred to as Freon gas).

However, Freon gas is known to destroy the earth's ozone layer and its use is now legally regulated. Hence, extensive researches have been made for an alternative refrigerant that poses no such problem. In this regard, carbon dioxide is anticipated to be a good candidate.

A type of rotary compressor is known, which utilizes carbon dioxide as a refrigerant (carbon dioxide will be hereinafter simply referred to as refrigerant unless it needs to be distinguished from other refrigerants) in a multistage compressor incorporating multiple compression elements.

Such multistage compressor comprises multiple compression elements for sucking, compressing, and discharging the refrigerant; a drive element for driving these compression elements, and a housing for accommodating the compression elements and the driving element.

Each of the multiple compression elements includes a roller which is fitted on an eccentric cam formed integral with a rotary shaft of the driving element and rolls on the inner wall of a cylinder. The space between the roller and the cylinder is divided into a suction chamber and a compression chamber by a vane that abuts on the roller. The multiple compression elements are adapted to sequentially perform suction, compression, and discharge of the refrigerant in multiple stages.

The driving element comprises an electric motor for rotating the shaft of the compression elements. These elements are all housed in a closed container.

However, in such a conventional multistage compressor as mentioned above, the atmosphere surrounding the driving elements does not flow, so that heat generated by the driving element stays inside the closed container, thereby raising the temperature of the driving element, which in turn hinders necessary compression of the refrigerant. This is a serious problem for apparatuses that utilize such compressor.

In other words, heat generated by the driving element must be radiated to the surroundings through the closed container, but it has become increasingly difficult to install a heat removing fan for removing heat from the compressor in a space around the compressor in order to meet a recent commercial request for an ever compact compressor.

Therefore, it has been an important matter in the design of a compressor to implement a mean for effectively radiating the heat generated by the driving element out of the closed container, hopefully without affecting the environment. A satisfactory solution, however, has not been found.

In order to overcome prior art problem as mentioned above, the invention provides a multistage compressor capable of efficiently suppressing heating of the driving element.

SUMMARY OF THE INVENTION

In accordance with one aspect of the invention, there is provided a multistage compressor having more than one compression elements for compressing a refrigerant, and a driving element for driving said compression elements, said driving element and said compressing elements accommodated in an enclosed container, said multistage compressor characterized in that the refrigerant is adapted to cool the driving element after the refrigerant is discharged from one of the compression elements and before it returns to the compression element in the next stage.

Thus, with such a simple arrangement of the compressor, the temperature rise of the driving element is efficiently suppressed.

Specifically, in one embodiment, a multistage compressor of the invention includes a closed container, a driving element in the form of an electric motor securely fixed in the upper section of the closed container; a two-stage compression element, provided in the lower section of the container, consisting of a first stage compression element and a second stage compression element which are driven by respective eccentric cams mounted on the shaft of the motor, characterized in that

- a connection tube is connected to the upper section of the closed container which extends outwardly therefrom and returns to the inlet of the second stage compression element through the lower section of the container;
- the refrigerant taken in the first stage compression element is compressed to an intermediate pressure (said refrigerant referred to as intermediate pressure gas) and discharged therefrom into the inner space of the closed container to cool the driving element;
- the intermediate pressure gas is returned to the second stage compression element through the connection tube; and
- the intermediate pressure gas is further compressed to a high pressure and discharged therefrom by a second stage discharge tube.

Instead of directly discharging the intermediate pressure gas from the first stage compression element into the inner space of the closed container, the gas may be alternatively discharged into the lower section of the closed container through a first stage connection tube which is connected to the outlet of the first stage compression element and extends once out of the container and returns to the lower section of the container.

Further, an additional refrigeration unit may be provided at an intermediate point of the first stage connection tube, or of the second stage connection tube, to enhance heat radiation from the refrigerant, which helps increase the amount of the gas sucked into the second stage compression element, thereby improving the compression efficiency.

BEST MODE FOR CARRYING OUT THE INVENTION

Preferred embodiments of a two-stage rotary compressor according to the invention will now be described in detail with reference to the accompanying drawings.

It should be understood, however, that the invention will not be limited to the embodiments described below, and that the invention may be applied to a compressor having more than two stages.

Figure 1:
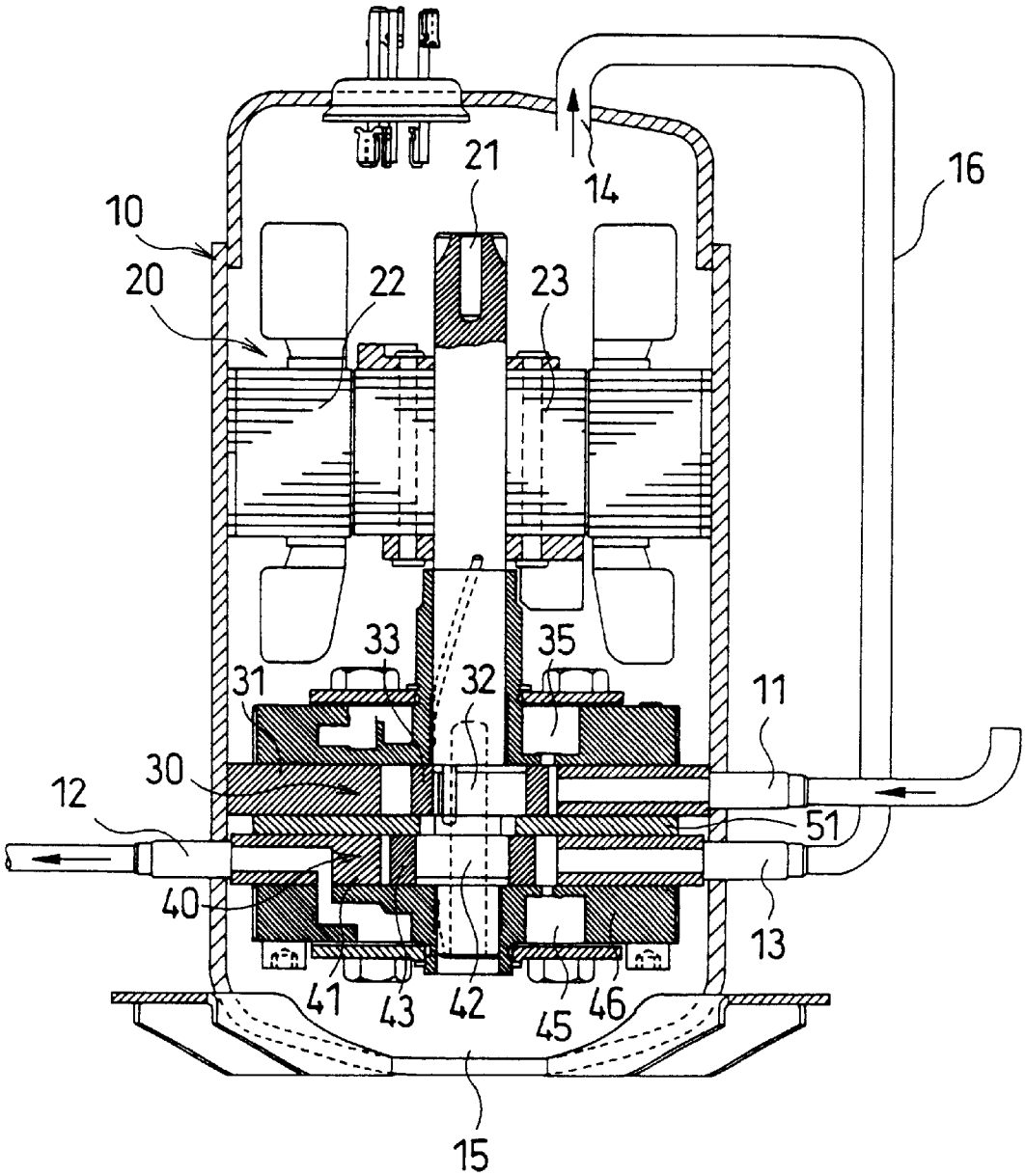
FIG. 1 is a cross sectional view of a preferred embodiment of a two-stage rotary compressor according to the invention.

As shown in FIG. 1, a rotary compressor includes a driving element in the form of an electric motor 20 and a first stage compression element 30 and second stage compression element 40 mounted below the motor 20, all accommodated in a closed container 10, adapted to compress in two stages carbon dioxide as a refrigerant.

Stored in the bottom section of the closed container 10 is a lubricant 15 for lubricating sliding elements of the compression elements 30 and 40.

The motor 20 consists of a stator 22 securely fixed on the closed container 10 by shrunk fit, a rotor 23 securely mounted on a shaft 21 which is rotatable with respect to the stator 22.

The first stage compression element 30 is provided at the inlet thereof with a suction tube 11 for suction of the refrigerant from an external source. The refrigerant is compressed by the first stage compression element 30 and discharged in the container 10 via a silencer chamber 35, as described in detail later.

The discharged refrigerant thus discharged flows past the motor 20 and into a second stage connection tube 16 via an inlet 14 of the connection tube provided in the upper section of the closed container 10, and further into the second stage compression element 40 from the suction tube 13 connected to the second stage connection tube 16.

The refrigerant is further compressed in the second stage compression element 40 before it is discharged out of the compressor through a discharge tube 12.

Suction mechanism and compression mechanism of the first stage compression element 30 and the second stage compression element 40 are the same in structure: they are formed of respective cylinders 31 and 41, respective rollers 33 and 43 installed inside the respective cylinders 31 and 41.

Figure 2:
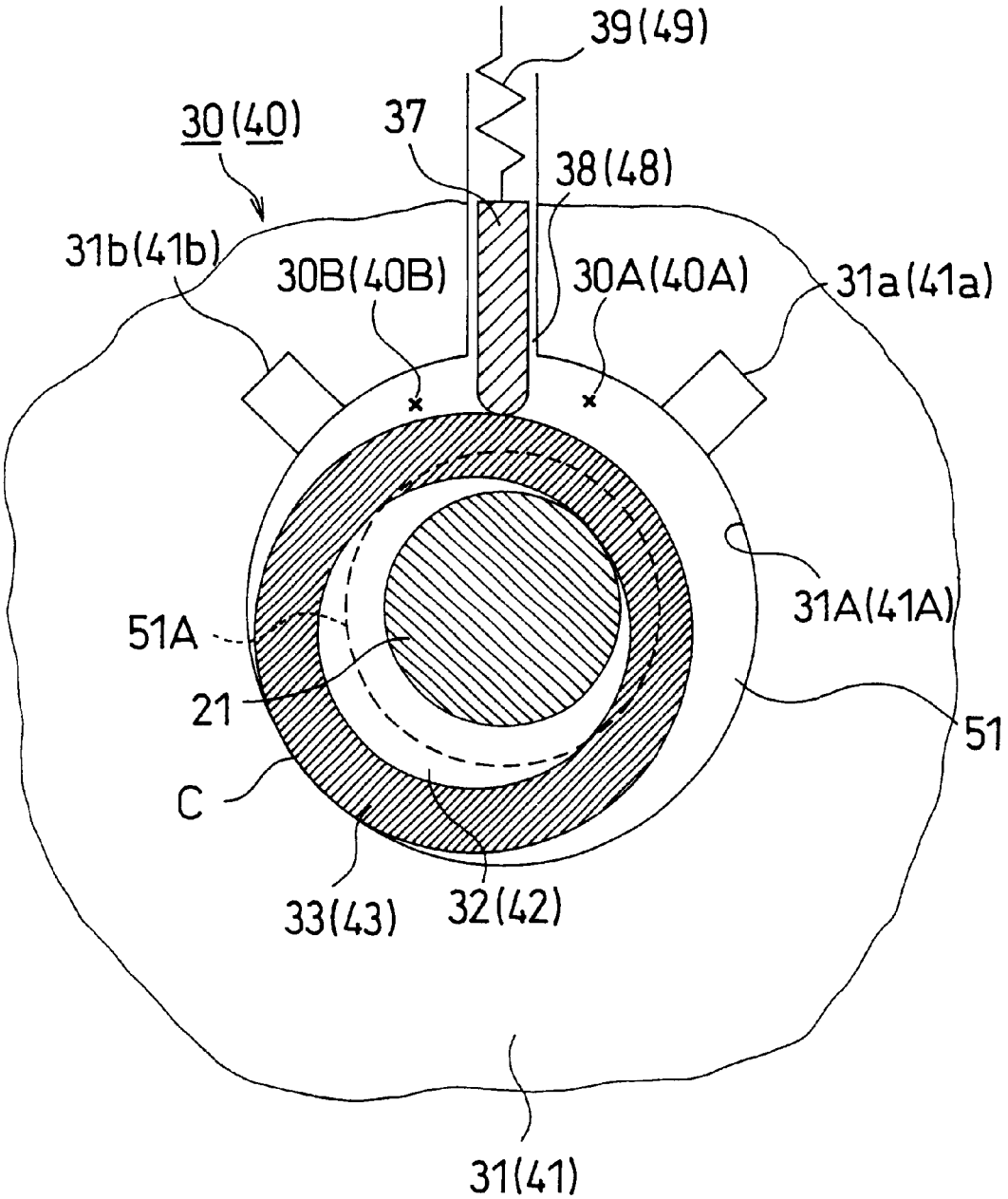
FIG. 2 is a partial cross sectional view of the two-stage rotary compressor of FIG. 1.

Referring to FIG. 2, there is shown a side cross section of the first stage compression element 30.

As seen in FIGS. 1 and 2, the first stage compression element 30 and second stage compression element 40 are formed of respective rollers 33 and 43 which are in rotational engagement with respective cams 32 and 42 formed on the rotary shaft 21, respective inner walls 31A and 41A of the cylinders 31 and 41, upper and lower support panels 36 and 46, and an intermediate partition panel 51.

Each of the upper and lower cams 32 and 42 is integrally formed on an extended section of the rotational shaft 21.

Rotatably fitted on the respective cams 32 and 42 are upper and lower rollers 33 and 43 such that the outer surfaces of the respective rollers 33 and 43 abut and roll on the respective inner walls 31A and 41A of the upper and lower cylinders 31 and 41.

The intermediate partition panel 51 is disposed between the upper and the lower cylinder 31 and 41 to separate them.

The intermediate panel 51 has a hole as indicated by a broken line in FIG. 2. The hole is necessary for an eccentric cam 42 to pass through it and the cylinders 31 and 41. The hole is coaxial with the rotational shaft 21.

An upper and a lower cylinder spaces are formed on the opposite sides of the intermediate panel 51 by enclosing the spaces defined by the outer surfaces of the respective rollers 33 and 43 and the inner walls 31A and 41A of the respective cylinders 31 and 41 by means of upper and lower support panels 36 and 46, respectively.

The upper and lower spaces are provided with respective upper and lower vanes 37 and 47 to partition the respective spaces. The vanes 37 and 47 are slidably mounted in the respective radial guiding grooves 38 and 48 formed in the respective cylinder walls of the upper and the lower cylinders 31 and 41, and biased by respective springs 39 and 49 so as to be in contact with the upper and lower rollers 33 and 43 at all times.

In order to carry out suction and discharge of the refrigerant gas into/out of the cylinder spaces, the cylinders are provided, on the opposite sides of the respective vanes 37 and 47, with upper and lower inlets 31*a* and 41*a* and outlets 31*b* and 41*b*, thereby forming an upper and lower suction spaces 30A and 40A, and upper and lower discharge spaces 30B and 40B.

The upper support panel 36 and lower support panel 46 are provided with respective discharge silencer chambers 35 and 45 which are appropriately communicated with the respective spaces 30B and 40B via discharge valves (not shown) provided at the respective outlets 31*b* and 41*b*.

The discharging valves are adapted to be opened when the pressure in the respective spaces 30B and 40B reaches a predetermined level.

In this arrangement, due to eccentric rotations of the respective eccentric rollers driven by the rotary shaft 21 of the motor 20, the refrigerant is sucked from an external source through the suction tube 11 into the suction space 30A via the inlet 31*a* of first stage compression element 30.

The low pressure refrigerant gas is transported to, and compressed in, the compression space 30B by the rolling motion of the roller 33 until its pressure reaches a prescribed intermediate pressure, when the valve provided at the outlet 31*b* is opened to allow the refrigerant gas to be discharged into the inner space of the closed container 10 through the silencer chamber 35.

The refrigerant discharged into the inner space of the closed container 10 cools the motor 20 as it flows upward past the motor 20 to the upper section of the closed container 10. The refrigerant then flows into the second stage connection tube 16 through the inlet 14 of the connection tube and is led into the 40A via the inlet 41*a* of the second stage compression element 40 through the suction tube 11.

The sucked refrigerant is transported by the rolling motion of the roller 33 to the compression space 40B and further compressed from the intermediate pressure to a prescribed higher pressure, when the valve provided at the outlet 41*b* is opened to discharge the refrigerant out of the compressor via the silencer chamber 45 and through the discharge tube 12.

In this way, the refrigerant discharged from the first stage compression element 30 refrigerates the stator 22 and the rotor 23 while passing through the motor 20. This flow effectively suppresses the temperature rise of the motor 20 even in cases where it is difficult to provide an external heat radiating air passage on the closed container 10 to remove heat from the driving element.

It might be thought that the refrigerant could be discharged equally well from the compression element in the last stage into the closed container to refrigerate the motor.

To do so, however, it is necessary to increase the maximum permissible pressure of the container, since carbon dioxide refrigerant generally has a much higher pressure in the last stage as compared with R-22 refrigerants. Hence, this approach is not necessarily advantageous from a point of cost performance.

Although the invention has been described with a particular reference to a preferred embodiment in which the motor 20 is refrigerated by the refrigerant compressed in the first stage compression element 30 and discharged into the closed container 10 via the silencer chamber 35, the invention is not limited to this embodiment.

Figure 3:
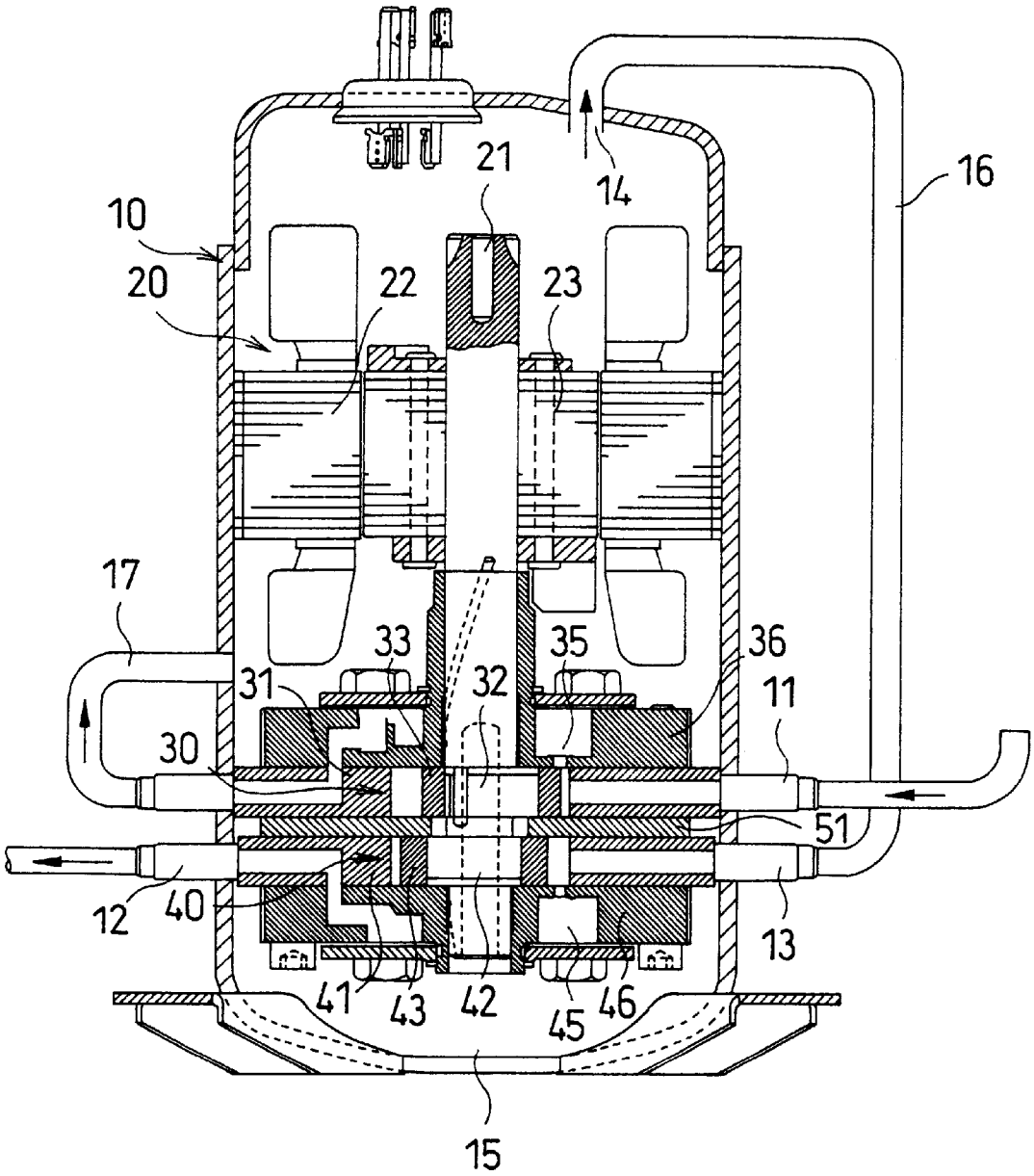
FIG. 3 is a cross sectional view of another preferred embodiment of a two-stage rotary compressor according to the invention.

For example, a first stage connection tube 17 connecting the outlet of the first stage compression element 30 to the lower section of the closed container 10 below the motor 20 may be provided so as to lead the refrigerant compressed by the first stage compression element 30 out of the compressor once and then lead it to the closed container 10, thereby refrigerating the motor 20 before the refrigerant is returned to the second stage connection tube 16, as shown in FIG. 3.

In this arrangement, the refrigerant effectively removes heat from the container and gets cooled outside the container as the refrigerant flows through the first stage connection tube 17 outside the container, thereby further facilitating cooling of the motor 20.

By making the first stage connection tube 17 of a material having a high thermal conductivity, cooling of the motor 20 may be enhanced.

Figure 4:
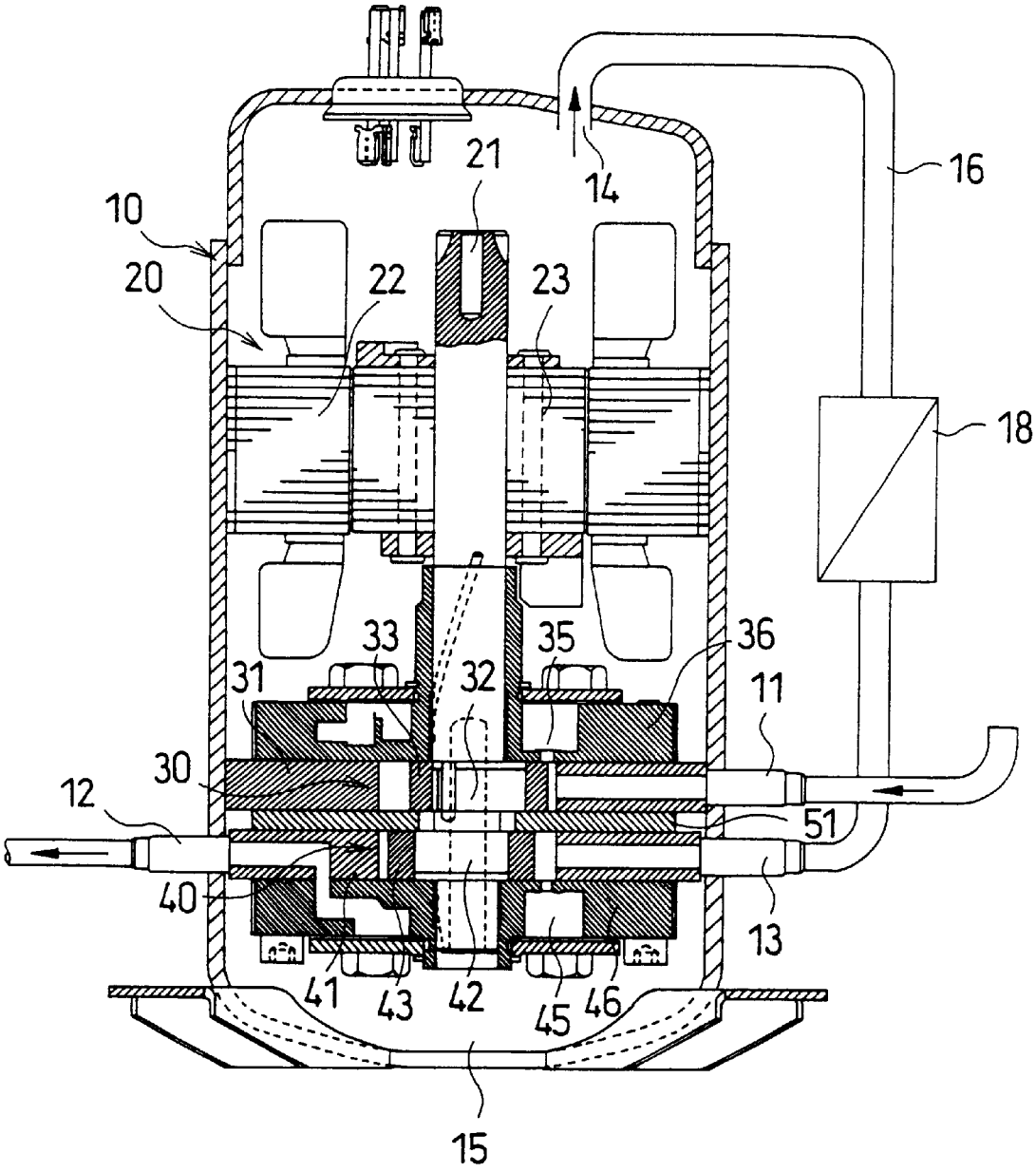
FIG. 4 is a cross sectional view of another preferred embodiment of a two-stage rotary compressor obtained by adding an extra refrigeration unit to the compressor shown in FIG. 1.
Figure 5:
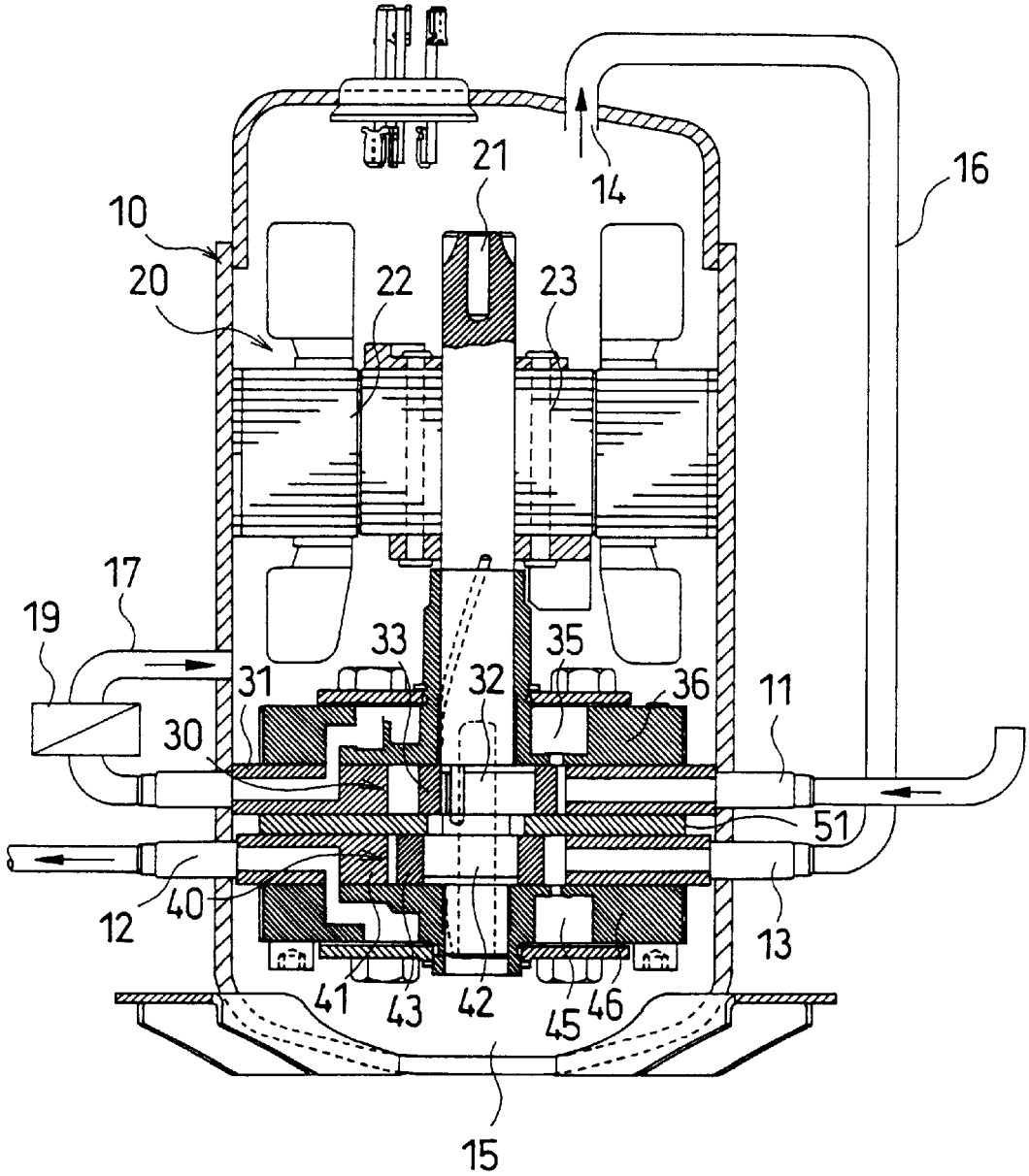
FIG. 5 is a cross sectional view of another preferred embodiment of a two-stage rotary compressor obtained by adding an extra refrigeration unit to the compressor shown in FIG. 2.

In addition, a further refrigeration unit 18 or 19 may be connected to the second stage connection tube 16 or the first stage connection tube 17, as shown in FIGS. 4 and 5.

If the refrigeration unit 18 is connected to the second stage connection tube 16, the amount of the refrigerant gas sucked into the second stage compression element 40 is increased, which will improve the compression efficiency.

If, on the other hand, the refrigeration unit 18 is connected to the first stage connection tube 17, cooling of the motor 20 is further enhanced, so that the amount of the refrigerant sucked into the second stage compression element 40 is increased accordingly, which will also improve the compression efficiency.

By making the second stage connection tube 16 and first stage connection tube 17 of a metal having a high thermal conductivity such as copper or aluminum, heat transfer from the motor 20 may be further increased to enhance the cooling effect.

INDUSTRIAL UTILITY OF THE INVENTION

As described above, the invention provides a simple heat removing mechanism suitable for multistage compressors for use in different types of refrigeration apparatuses and air conditioners.

A refrigerant efficiently cools the driving element of the compressor between two compression stages as it is discharged into the closed container after a first stage and returns to the second stage of compression, thereby solving the heat radiation problem pertinent to conventional compressors.

What is claim is:

1. A multistage compressor including more than one compressing elements for compressing a refrigerant, and a driving element for driving said compression elements, said driving element and said compressing elements accommodated in an enclosed container, characterized in that said refrigerant is discharged from one compression element directly to a discharge silencer chamber inside said enclosed container to cool said driving element before it returns to the compression element in the next stage.

2. The multistage compressor according to claim 1, characterized in that said refrigerant discharged from said one compression element and having cooled said driving element flows out of said closed container and then returns to said compression element in the next stage through a connection tube connected to an upper section of said closed container and inlet of said compression element in the next stage.

3. A multistage compressor, including a closed container; a driving element in the form of an electric motor securely fixed in an upper section of said closed container; and a first stage and second stage compression elements provided in a lower section of said closed container for carrying out suction, compression and discharge of refrigerant in response to rotations of associated upper and lower cams mounted on the shaft of said motor, said compressor characterized by:

a first stage refrigerant suction tube introduced from outside of said closed container and connected to said first stage compression element;

a connection tube that extends out of the upper section of said closed container and returns to an inlet of said second stage compression element; and a second stage refrigerant discharge tube connected to an outlet of said second stage compression element and extending out of said closed container, wherein low-pressure refrigerant sucked into said first stage compression element through said pre-stage refrigerant suction tube is compressed to an intermediate pressure; said refrigerant compressed to the intermediate pressure is discharged from the outlet of said first stage compression element directly to a discharge silencer chamber inside said enclosed container, thereby cooling said driving element; said refrigerant discharged into said closed container is returned to the inlet of said second stage compression element through said connection tube; and that said refrigerant sucked into said second stage compression element is compressed to a high pressure in said second stage compression element before said refrigerant is discharged by said second stage refrigerant discharge tube out of said closed container.

4. The multistage compressor according to claim 3, wherein each of said first stage compression element and second stage compression element comprises:

upper and lower eccentric cams formed on the shaft of said motor;

two rollers rotatably fitted on said eccentric cams;

two cylinders each having an inner surface on which outer surface of said roller rotatably abuts as said shaft is rotated;

an intermediate partition panel separating said cylinders;

two support panels enclosing the upper and lower ends of the respective cylinders;

two vanes, one for each cylinders for partitioning a respective closed space defined by the respective outer surface of said roller, inner surface of said cylinder, said support panel, and said intermediate panel, into a suction space and a discharge space;

two inlets, one for each cylinder, for sucking refrigerant into said suction spaces;

two outlets, one for each cylinder, for discharging compressed refrigerant out of the respective discharge spaces, and wherein the refrigerant sucked into the respective discharging spaces via said respective inlets is compressed in the respective discharge spaces and discharged from the respective outlets in response to the rotation of said shaft.

* * * * *